US007204219B2

(12) United States Patent
Sakurai

(10) Patent No.: US 7,204,219 B2
(45) Date of Patent: Apr. 17, 2007

(54) VALVE OPERATING MECHANISM WITH ROLLER ROCKER ARM, 4-CYCLE ENGINE, AND MOTORCYCLE HAVING 4-CYCLE ENGINE MOUNTED THEREON

(75) Inventor: Motoki Sakurai, Shizuoka (JP)

(73) Assignee: Yamaha Hatsudoki Kabushiki Kaisha, Iwata-shi (JP)

( * ) Notice: Subject to any disclaimer, the term of this patent is extended or adjusted under 35 U.S.C. 154(b) by 0 days.

(21) Appl. No.: 10/527,248

(22) PCT Filed: Jul. 23, 2004

(86) PCT No.: PCT/JP2004/010879

§ 371 (c)(1),
(2), (4) Date: Sep. 28, 2005

(87) PCT Pub. No.: WO2005/017322

PCT Pub. Date: Feb. 24, 2005

(65) Prior Publication Data

US 2006/0096564 A1 May 11, 2006

(30) Foreign Application Priority Data

Aug. 18, 2003 (JP) ..... 2003-207668

(51) Int. Cl.
*F01L 1/18* (2006.01)

(52) U.S. Cl. ..... 123/90.39; 123/90.44; 123/90.16; 74/569

(58) Field of Classification Search ..... 123/90.16, 123/90.2, 90.27, 90.31, 90.39, 90.41, 90.44; 74/559, 567, 569
See application file for complete search history.

(56) References Cited

U.S. PATENT DOCUMENTS 5,121,716 A * 6/1992 Takahashi et al. ..... 123/531
6,705,264 B2 * 3/2004 Onoue ..... 123/90.39

FOREIGN PATENT DOCUMENTS

| | | |
|---|---|---|
| JP | 54-145736 U | 10/1979 |
| JP | 63-295811 A | 12/1988 |
| JP | 02-161119 A | 6/1990 |
| JP | 07-068892 | 3/1995 |
| JP | 07-097938 A | 4/1995 |

* cited by examiner

*Primary Examiner*—Ching Chang
(74) *Attorney, Agent, or Firm*—Keating & Bennett, LLP

(57) ABSTRACT

A valve gear includes a camshaft having valve gear cams, first and second rocker shafts, a first rocker arm supported on the first rocker shaft, and a second rocker arm supported on the second rocker shaft: The valve gear cams, respectively, include a cam nose projecting from a base circle, and the first rocker shaft supporting the first rocker arm is positioned forwardly of a center line, which passes through a center of the camshaft to extend axially of a cylinder, in a direction of rotation of the camshaft:. The first rocker shaft is shifted closer to the camshaft than a center of rotation of a roller bearing is, when the roller bearing won the first rocker arm contacts with the base circle of the valve gear cam.

52 Claims, 5 Drawing Sheets

VALVE OPERATING MECHANISM WITH ROLLER ROCKER ARM, 4-CYCLE ENGINE, AND MOTORCYCLE HAVING 4-CYCLE ENGINE MOUNTED THEREON

This Application is a National Stage application under U.S.C. § 371 based on International Application No. PCT/JP2004/010879 filed on Jul. 23, 2004, and further claims priority under 35 U.S.C. § 119 of Japanese Application No. 2003-207668, filed on Aug. 18, 2003.

BACKGROUND OF THE INVENTION

1. Field of the Invention

The present invention relates to a valve gear including rocker arms having roller bearings at contact portions thereof with valve gear cams, and an overhead cam type four-cycle engine having such a valve gear. Further, the present invention relates to a vehicle such as a motorcycle including a four-cycle engine and such a valve gear.

2. Description of the Related Art

So-called SOHC (Single Overhead Camshaft) type four-cycle engines are known and include a single camshaft that drives exhaust valves and intake valves. This type of four-cycle engine includes an exhaust rocker arm, which transmits movements of an exhaust cam to exhaust valves, and an intake rocker arm, which transmits movements of an intake cam to intake valves.

The exhaust rocker arm and the intake rocker arm, respectively, are swingably supported on rocker shafts. The rocker shafts are arranged in parallel to each other with a camshaft therebetween. Therefore, the exhaust rocker arm is located across the rocker shaft from the exhaust cam and extends toward the exhaust valves, and the intake rocker arm is located across the rocker shaft from the intake cam and extends toward the intake valves.

JP-B-07-068892 discloses a valve gear for four-cycle engines, in which roller bearings are incorporated into an exhaust rocker arm and an intake rocker arm, respectively. The roller bearings come into rolling contact with an exhaust cam and an intake cam to thereby restrict a frictional resistance to a small amount, the frictional resistance being generated at contact portions between the exhaust rocker arm and the exhaust cam and at contact portions between the intake rocker arm and the intake cam.

In this conventional valve gear, when rotation of a camshaft causes the roller bearing of the intake rocker arm to contact a cam nose of the intake cam as it moves from a base circle thereof, the cam nose pushes up the roller bearing. As a result, the intake rocker arm swings on a rocker shaft to push intake valves in an opening direction.

The rocker shaft, which supports the intake rocker arm, is positioned rearwardly of a centerline, which passes through a center of the camshaft extending axially of a cylinder, in a direction of rotation of the camshaft. Therefore, when the cam nose pushes up the roller bearing of the intake rocker arm, the rocker shaft, which supports the intake rocker arm, is not moved in a direction in which the roller bearing is pushed up.

In other words, in a process in which the cam nose of the intake cam pushes up the roller bearing, a force exerted on a contact portion, at which the cam nose and the roller bearing contact with each other, acts in a direction intersecting a line which connects a center of rotation of the roller bearing and a center of the rocker shaft. Accordingly, a force with which the cam nose pushes up the roller bearing acts as a force by which the intake rocker arm is caused to swing on the rocker shaft, so that any undesired force will not be applied to the intake rocker arm.

On the other hand, the rocker shaft, which supports the exhaust rocker arm, is positioned forwardly of a centerline, which passes through the center of the camshaft in the direction of rotation of the camshaft. Therefore, in a process in which the cam nose of the exhaust cam pushes up the roller bearing of the exhaust rocker arm, that rocker shaft which supports the exhaust rocker arm is moved in a direction in which the roller bearing is pushed up. Accordingly, a force exerted on a contact portion at which the cam nose and the roller bearing contact each other, acts along a line which connects a center of rotation of the roller bearing and a center of the rocker shaft.

As a result, a force with which the cam nose pushes up the roller bearing, acts as a force which causes the exhaust rocker shaft to buckle, so that a load being applied on and borne by the exhaust rocker arm is increased.

Accordingly, it is necessary to take various measures to enable the exhaust rocker arm to handle such a buckling load. As a result, the exhaust rocker arm becomes disadvantageously heavy and large in size.

SUMMARY OF THE INVENTION

In order to overcome the problems described above, preferred embodiments of the present invention provide a valve gear that is capable of preventing a buckling load from being applied to a first rocker arm and decreases a load being borne by the first rocker arm so that the first rocker arm does not have to be reinforced and made larger.

Also, preferred embodiments of the present invention provide a four-cycle engine having such a novel valve gear, and a motorcycle include the engine having the novel valve gear.

A valve gear according to a first preferred embodiment of the present invention includes a camshaft having a first valve gear cam and a second valve gear cam, first and second rocker shafts arranged such that the camshaft is disposed between the first and second rocker shafts, a first rocker arm swingably supported on the first rocker shaft and having a roller bearing at one end thereof, the roller bearing of the first rocker arm being arranged to contact with the first valve gear cam, and a second rocker arm swingably supported on the second rocker shaft and having a roller bearing at one end thereof, the roller bearing of the second rocker arm being arranged to contact with the second valve gear cam, wherein the first and second valve gear cams of the camshaft, respectively, include a base circle and a cam nose projecting from the base circle, and the first rocker arm and the first valve gear cam are arranged such that when the roller bearing of the first rocker arm contacts with the base circle of the first valve gear cam, the first rocker shaft is located closer to the camshaft than a location of a center of rotation of the roller bearing of the first rocker arm.

With such a unique construction, when the camshaft rotates, the cam noses of the first and second valve gear cams push up the roller bearings of the first and second rocker arms.

Since the cam nose is moved in a direction away from the second rocker shaft during this process in which the cam nose of the second valve gear cam pushes up the roller bearing, the second rocker shaft will not be moved in a direction in which the roller bearing is pushed up. Therefore, a force with which the cam nose pushes up the roller bearing acts as a force by which the second rocker arm is caused to swing on the second rocker shaft.

On the other hand, when the roller bearing of the first rocker arm contacts with the base circle of the first valve gear cam, the first rocker shaft, which supports the first rocker arm, is located closer to the camshaft than the location of the center of rotation of the roller bearing. Therefore, the first rocker shaft will not be moved in a direction in which the roller bearing is pushed up during the process in which the cam nose of the first valve gear cam pushes up the roller bearing.

Thus, the first rocker arm and the first valve gear cam are preferably arranged such that a relationship between relative positions of a center of the first rocker shaft, a center of rotation of the roller bearing of the first rocker arm, and a center of rotation of the camshaft is such that the first rocker arm does not buckle when the cam nose of the first valve gear cam contacts with the roller bearing of the first rocker arm to cause the first rocker arm to swing in a valve opening direction In addition, the first rocker arm and the first valve gear cam are preferably arranged such that when the roller bearing of the first rocker arm contacts with the base circle of the first valve gear cam, a force exerted on a contact portion at which the cam nose and the roller bearing of the first rocker arm contact each other does not act along a line which connects a center of rotation of the roller bearing of the first rocker shaft and a center of the first rocker shaft.

As a result of this unique construction, the force on the first rocker arm is greatly reduced and the first rocker arm does not need to be reinforced or enlarged.

It is preferred that the first rocker shaft is arranged to support the first rocker arm and is positioned forwardly of a center line which passes through a center of the camshaft to extend axially of a cylinder in a direction of rotation of the camshaft, and the second rocker shaft is arranged to support the second rocker arm and is positioned rearwardly of the center line in the direction of rotation of the camshaft.

The roller bearing of the first rocker arm and the roller bearing of the second rocker arm, respectively, are preferably offset relative to the center line of the cylinder in an axial direction of the camshaft, and the roller bearing of the first rocker arm offset farther from the center line than the roller bearing of the second rocker arm.

With the arrangement and movement described above, the first rocker arm preferably opens and closes at least one exhaust valve and the second rocker arm preferably opens and closes at least one intake valve.

In a preferred embodiment of the present invention, the following relationship is satisfied: $\theta 1 > \theta 2$, wherein $\theta 1$ indicates an intersecting angle between a line which connects the center of the first rocker shaft and the center of rotation of the roller bearing of the first rocker arm, and a line which connects a center of rotation of the camshaft and the center of rotation of the roller bearing of the first rocker arm, and $\theta 2$ indicates an intersecting angle between a line which connects a center of the second rocker shaft and a center of rotation of the roller bearing of the second rocker arm, and a line which connects the center of rotation of the camshaft and the center of rotation of the roller bearing of the second rocker arm.

The intersecting angle $\theta 1$ is preferably larger than approximately 90 degrees and the intersecting angle $\theta 2$ is preferably smaller than approximately 90 degrees.

In another preferred embodiment of the present invention, an engine includes the valve gear according to the preferred embodiment described above. This engine is preferably a four-cycle engine.

According to yet another preferred embodiment of the present invention, a vehicle includes the engine described above having the valve gear according to the preferred embodiment described above, and the vehicle is preferably a motorcycle.

In a further preferred embodiment of the present invention, a four-cycle engine includes a cylinder having a bore center line, a cylinder head connected to the cylinder and having an exhaust valve and an intake valve, a camshaft supported by the cylinder head and having a first valve gear cam and a second valve gear cam, first and second rocker shafts arranged such that the camshaft is disposed between the first and second rocker shafts, a first rocker arm swingably supported on the first rocker shaft and having a roller bearing at one end thereof, the roller bearing of the first rocker arm being arranged to contact with the first valve gear cam, the first rocker arm acting to drive one of the exhaust valve and the intake valve, and a second rocker arm swingably supported on the second rocker shaft and having a roller bearing at one end thereof, the roller bearing of the second rocker arm being arranged to contact with the second valve gear cam, the second rocker arm acting to drive the other of the exhaust valve and the intake valve, wherein the first and second valve gear cams of the camshaft, respectively, include a base circle and a cam nose projecting from the base circle, and the first rocker arm and the first valve gear cam are arranged such that when the roller bearing of the first rocker arm contacts with the base circle of the first valve gear cam, the first rocker shaft is located closer to the camshaft than a location of a center of rotation of the roller bearing of the first rocker arm.

The exhaust valve and the intake valve, respectively, preferably include a valve stem at a first end thereof, and the first rocker arm and the second rocker arm, respectively, preferably include another end to push the valve stem, and the cylinder head includes a first opening to expose abutting portions of the other end of the first rocker arm and the valve stem, and a second opening to expose abutting portions of the other end of the second rocker arm and the valve stem, the first opening and the second opening being arranged to be opposed to each other with the bore center line therebetween and covered by respective common removable covers, and the covers include first and second walls on inner surfaces thereof which are opposed to the abutting portions and arranged to receive a lubricating oil, the first wall being formed with supply ports through which the lubricating oil is applied to the abutting portions of the other end of the first rocker arm and the valve stem, and the second wall being formed with supply ports through which the lubricating oil is applied to the abutting portions of the other end of the second rocker arm and the valve stem.

Other features, elements, characteristics and advantages of the present invention will become more apparent from the following detailed description of preferred embodiments with reference to the attached drawings.

DETAILED DESCRIPTION OF PREFERRED EMBODIMENTS

Preferred embodiments of the present invention will be described below with reference to the drawings.

Figure 1:
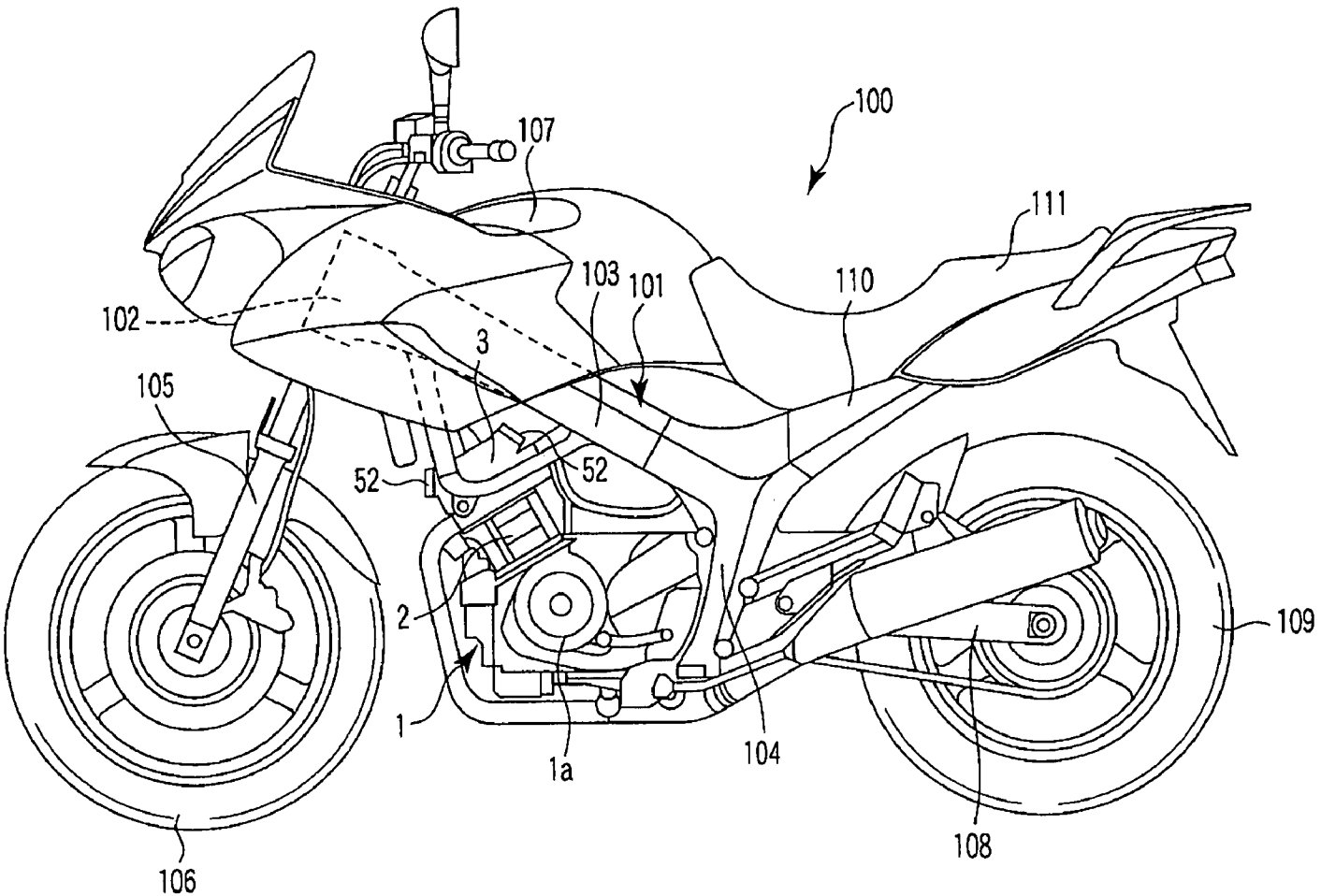
FIG. 1 is a side view showing a motorcycle according to a preferred embodiment of the invention.

FIG. 1 shows a motorcycle 100 according to a preferred embodiment of the invention. The motorcycle 100 preferably includes a frame 101. The frame 101 includes a head pipe 102, left and right main frames 103 (only one of them being shown), and left and right rear-arm brackets 104 (only one of them being shown).

The head pipe 102 is positioned at a front end of the frame 101 to support a front wheel 106 through a front fork 105. The main frames 103 extend rearwardly of the head pipe 102 and incline downward as they extend rearwardly of the head pipe 102. The main frames 103 support a fuel tank 107.

The rear-arm brackets 104 project downward from rear ends of the main frames 103. The rear-arm brackets 104 pivotally support a rear arm 108. The rear arm 108 extends rearwardly of the rear-arm brackets 104. A rear wheel 109 is supported at a rear end of the rear arm 108.

Left and right seat rails 110 (only one of them being shown) are connected to upper ends of the rear-arm brackets 104. The seat rails 110 pass above the rear wheel 109 to extend rearwardly of the rear-arm brackets 104. The seat rails 110 support a seat 111. The seat 111 is connected at its front end to the fuel tank 107.

As shown in FIG. 1, the frame 101 supports a water-cooled four-cycle single cylinder engine 1, for example, which drives the rear wheel 109. The engine 1 is disposed below the main frames 103 and supported by the main frames 103 and the rear-arm brackets 104.

Figure 2:
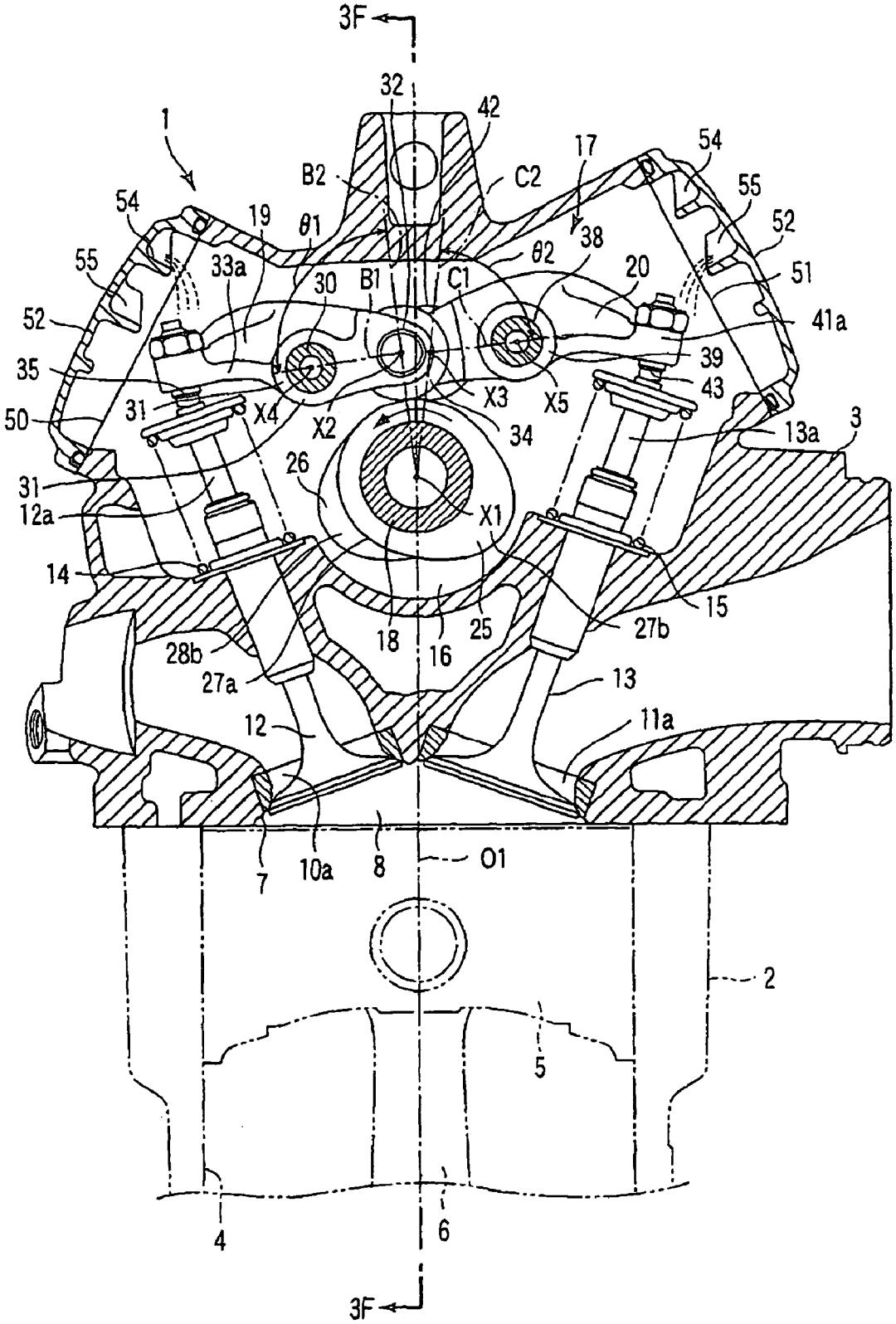
FIG. 2 is a cross-sectional view showing the positional relationship among a camshaft, an exhaust rocker arm, and an intake rocker arm in a four-cycle engine according to a preferred embodiment of the invention.

As shown in FIGS. 1 and 2, the engine 1 preferably includes a crankcase 1*a*, a cylinder block 2, and a cylinder head 3. The crankcase 1*a* accommodates therein a crank shaft (not shown). The cylinder block 2 stands upright from an upper surface of the crankcase 1*a*. The cylinder block 2 includes a cylinder 4. The cylinder 4 accommodates therein a piston 5. The piston 5 is connected through a connecting rod 6 to the crank shaft.

The cylinder head 3 is connected to an upper surface of the cylinder block 2. The cylinder head 3 includes a recess 7 located on a surface thereof that is opposed to the cylinder 4. The recess 7 defines a pent roof type combustion chamber 8 between the recess 7 and a top surface of the piston 5.

Figure 4:
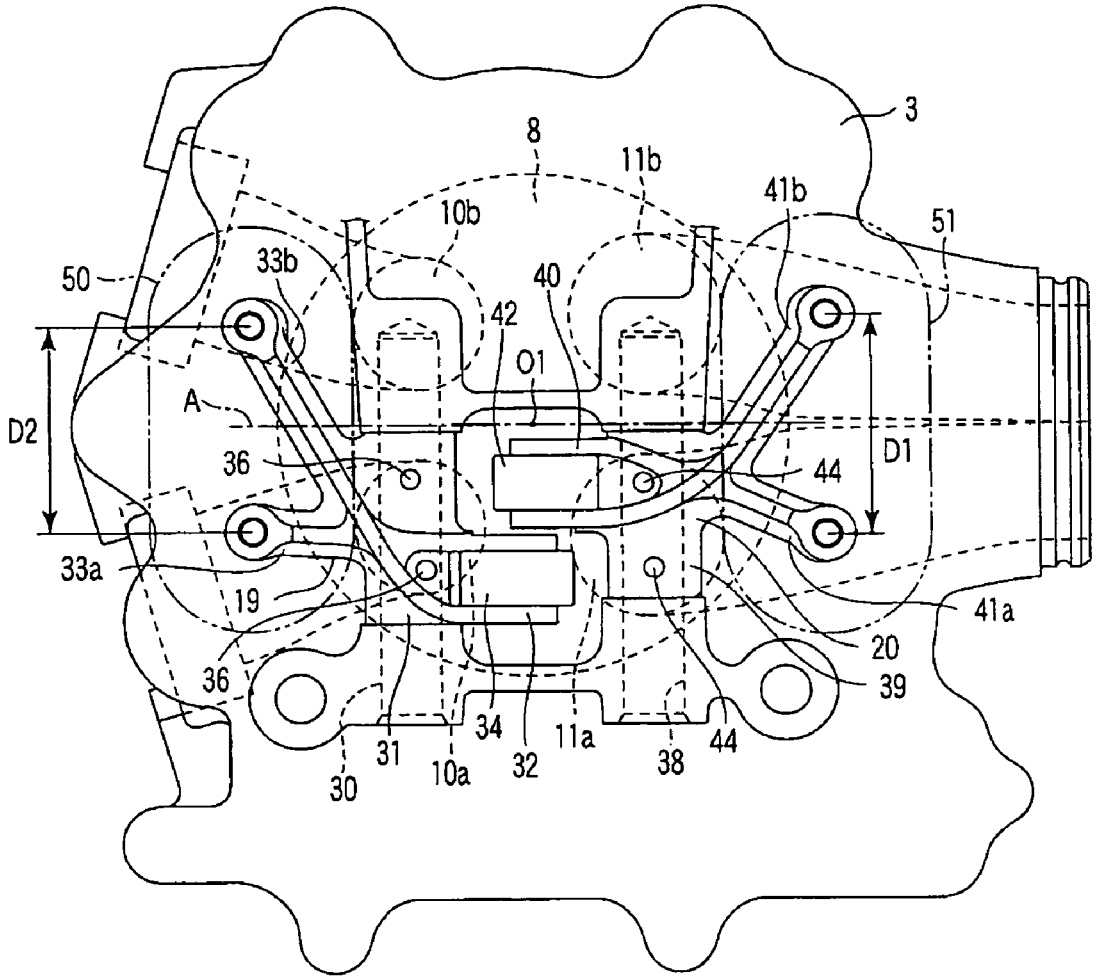
FIG. 4 is a plan view showing the positional relationship between the exhaust rocker arm and the intake rocker arm in a four-cycle engine according to a preferred embodiment of the invention.

As shown in FIGS. 2 and 4, the cylinder head 3 includes a pair of exhaust ports 10*a*, 10*b* and a pair of intake ports 11*a*, 11*b*. The exhaust ports 10*a*, 10*b* and the intake ports 11*a*, 11*b* are opened to the combustion chamber 8 and arranged to be opposed to each other with a bore center line O1 of the cylinder 4, which passes through a center of the combustion chamber 8, extending therebetween.

The cylinder head 3 supports two exhaust valves 12, which open and close the exhaust ports 10*a*, 10*b*, and two intake valves 13, which open and close the intake ports 11*a*, 11*b*. Valve stems 12*a* of the exhaust valves 12 are arranged substantially parallel to each other and inclined in a direction such that portions of the valve stems 12*a* are located farther away from the bore center line O1 as the portions of the valve stems 12*a* become more distant from the combustion chamber 8. Valve stems 13*a* of the intake valves 13 are arranged substantially parallel to each other and inclined in an opposite direction to that of the valve stems 12*a* of the exhaust valves 12 relative to the bore center line O1.

The valve stems 12*a* of the exhaust valves 12 are shorter in total length than the valve stems 13*a* of the intake valves 13. Therefore, tip ends of the valve stems 12*a* are positioned below tip ends of the valve stems 13*a*.

The exhaust valves 12 are biased in a direction in which the exhaust ports 10*a* and 10*b* are closed by valve springs 14. Likewise, the intake valves 13 are biased in a direction in which the intake ports 11*a* and 11*b* are closed by valve springs 15.

Figure 3:
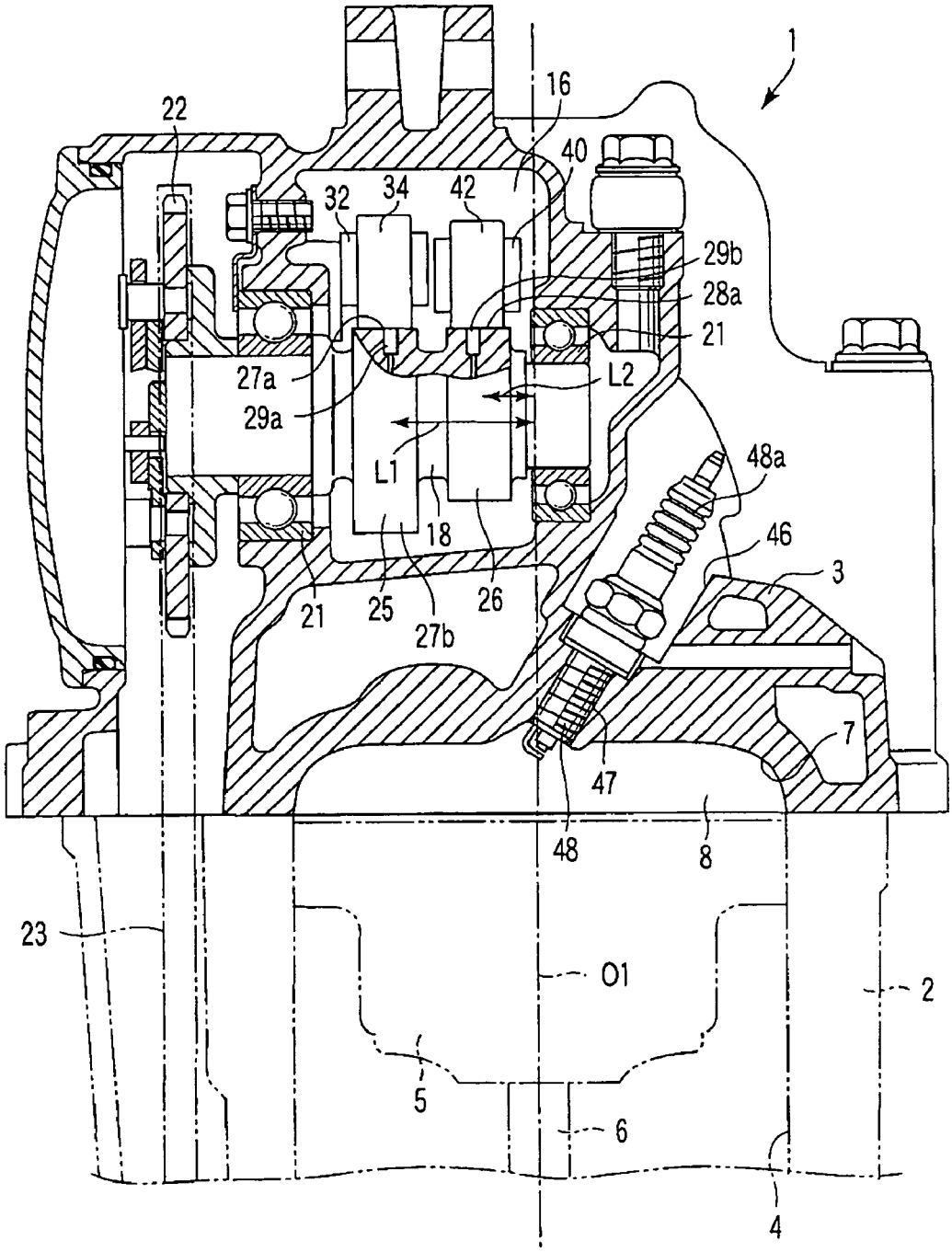
FIG. 3 is a cross sectional view taken along the line F3—F3 in FIG. 2.

As shown in FIGS. 2 and 3, a valve gear chamber 16 is formed within the cylinder head 3. The valve gear chamber 16 is positioned just above the combustion chamber 8. Tip ends of the valve stems 12*a* of the exhaust valves 12 and tip ends of the valve stems 13*a* of the intake valves 13 project into the valve gear chamber 16.

The valve gear chamber 16 accommodates therein a valve gear 17 that drives the exhaust valves 12 and the intake valves 13. The valve gear 17 includes a single camshaft 18, an exhaust rocker arm 19 defining a first rocker arm, and an intake rocker arm 20 defining a second rocker arm.

The camshaft 18 is supported at its one end and its other end through bearings 21 by the cylinder head 3. A center X1 of rotation of the camshaft 18 is substantially perpendicular to the bore center line O1. One end of the camshaft 18 is positioned in the vicinity of the bore center line O1. Therefore, the camshaft 18 is offset radially of the cylinder 4 relative to the bore center line O1.

The other end of the camshaft 18 is disposed outside the valve gear chamber 16. A sprocket 22 is fixed to the other end of the camshaft 18. A cam chain 23 is stretched between the sprocket 22 and the crank shaft. According to the present preferred embodiment, the camshaft 18 rotates forward in a counterclockwise direction (a direction of rotation of the front wheel 106 when the motorcycle 100 advances) indicated by an arrow in FIG. 2.

As shown in FIG. 3, the camshaft 18 includes an exhaust cam 25 defining a first valve gear cam, and an intake cam 26 defining a second valve gear cam. The exhaust cam 25 and the intake cam 26 are aligned axially relative to the camshaft 18. When the cylinder head 3 is viewed axially of the cylinder 4, the exhaust cam 25 and the intake cam 26 are offset axially of the camshaft 18 relative to the bore center line O1. An amount L1 of offset of the exhaust cam 25 relative to the bore center line O1 is larger than an amount L2 of offset of the intake cam 26 relative to the bore center line O1.

As shown in FIG. 2, the exhaust cam 25 includes a base circle 27*a*, which maintains the exhaust valves 12 in a closed state, and a cam nose 27*b*, which actuates the exhaust valves 12 in a direction of opening. The cam nose 27*b* extends beyond the base circle 27*a*.

Likewise, the intake cam 26 includes a base circle 28*a*, which maintains the intake valves 13 in a closed state, and a cam nose 28*b*, which actuates the intake valves 13 in a direction of opening. The cam nose 28*b* extends beyond the base circle 28*a*.

Figure 6:
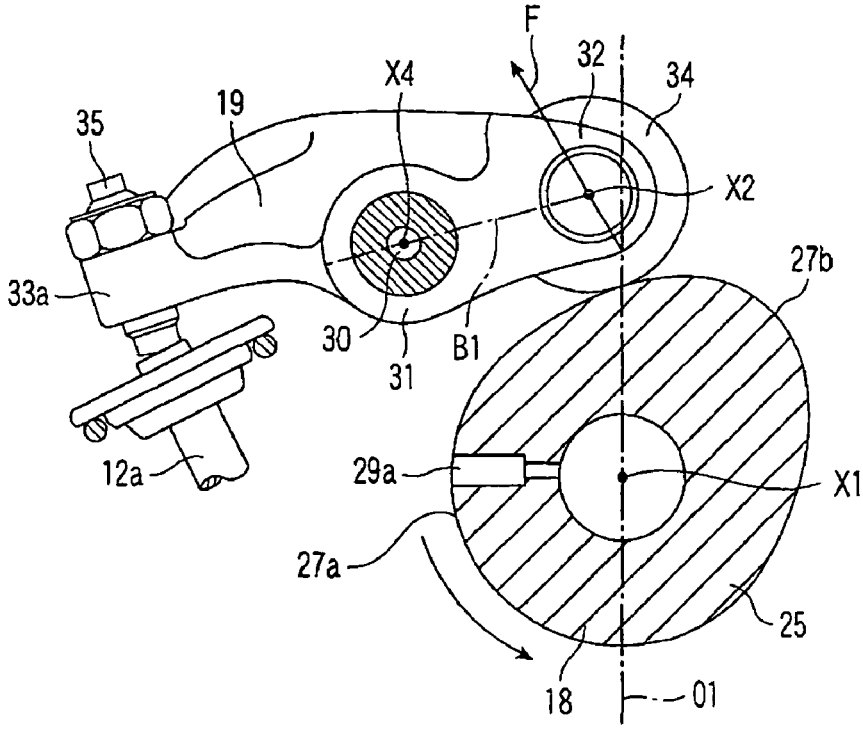
FIG. 6 is a cross-sectional view showing a state, in which a roller bearing of the exhaust rocker arm is pushed up by a cam nose of an exhaust cam, in the embodiment of the invention.

As shown in FIGS. 3 and 6, oil jet ports 29*a*, 29*b*, respectively, are formed in the exhaust cam 25 and the intake cam 26. The oil jet port 29*a* is opened to an outer peripheral surface of the base circle 27*a* of the exhaust cam 25. The oil jet port 29*b* is opened to an outer peripheral surface of the base circle 28*a* of the intake cam 26. The oil jet ports 29*a*, 29*b* are arranged to supply a lubricating oil to respective parts of the valve gear 17. Therefore, the lubricating oil that is pressurized by an oil pump is applied on a circumference of the camshaft 18 through the oil jet ports 29*a*, 29*b*.

As shown in FIGS. 2 and 4, the exhaust rocker arm 19 is swingably supported by a first rocker shaft 30 on the cylinder head 3. The first rocker shaft 30 is substantially parallel to and disposed above the camshaft 18. Further, the first rocker shaft 30 is positioned forwardly of the bore center line O1 which passes through the center X1 of rotation of the camshaft 18, in a direction of rotation of the camshaft 18. In other words, the first rocker shaft 30 is positioned between the camshaft 18 and the valve stems 12*a* of the exhaust valves 12.

The exhaust rocker arm 19 includes a substantially cylindrical-shaped boss 31, a roller support 32, and a pair of push arms 33*a*, 33*b*. The boss 31 is swingably supported on the first rocker shaft 30. The boss 31 is offset on one side in an axial direction of the first rocker shaft 30 relative to the bore center line O1.

The roller support 32 is arranged to bifurcate and to project toward the exhaust cam 25 from an outer peripheral surface of the boss 31 The roller support 32 rotatably supports a roller bearing 34. The roller bearing 34 is positioned at one end of the exhaust rocker arm 19 to come into rolling contact with the base circle 27*a* and the cam nose 27*b* of the exhaust cam 25. A center X2 of rotation of the roller bearing 34 is offset toward the first rocker shaft 30 relative to the bore center line O1, which passes through the center X1 of rotation of the camshaft 18.

As shown in FIG. 4, the push arms 33*a*, 33*b* project toward the valve stems 12*a* of the exhaust valves 12 from the outer peripheral surface of the boss 31. The two valve stems 12*a* are evenly distributed with the bore center line O1 therebetween. In contrast, the boss 31 is offset on one side in the axial direction of the first rocker shaft 30 relative to the bore center line O1. Therefore, one 33*a* of the push arms and the other 33*b* of the push arms are different in length from each other. The other 33*b* of the push arms, which pushes the valve stem 12*a* disposed away from the boss 31, crosses a line A, which extends radially of the combustion chamber 8 so as to be substantially perpendicular to the bore center line O1 and the camshaft 18.

Projecting ends of the push arms 33*a*, 33*b* are positioned at the other end of the exhaust rocker arm 19 and opposed to the tip ends of the valve stems 12*a*, as seen in FIG. 6. Adjust screws 35, respectively, are screwed into the projecting ends of the push arms 33*a*, 33*b*. The adjust screws 35 abut against the tip ends of the valve stems 12*a*. Accordingly, the exhaust rocker arm 19 extends across the first rocker shaft 30 from the exhaust cam 25 to the tip ends of the valve stems 12*a* of the exhaust valve 12.

Further, a pair of oil supply ports 36 are formed on the boss 31 of the exhaust rocker arm 19 as shown in FIG. 4. The oil supply ports 36 receive the lubricating oil applied from the oil jet ports 29*a*, 29*b* of the camshaft 18 to apply the oil between the boss 31 and the first rocker shaft 30. The oil supply ports 36 are spaced away from each other in an axial direction of the boss 31.

As shown in FIGS. 2 and 4, the intake rocker arm 20 is swingably supported on the cylinder head 3 through a second rocker shaft 38. The second rocker shaft 38 is substantially parallel to and disposed above the camshaft 18. The second rocker shaft 38 is positioned rearwardly of the bore center line O1, which passes through the center X1 of rotation of the camshaft 18, in the direction of rotation of the camshaft 18. Therefore, the first rocker shaft 30 and the second rocker shaft 38 are arranged substantially parallel to each other with the camshaft 18 located therebetween.

The intake rocker arm 20 includes a substantially cylindrical-shaped boss 39, a roller support 40, and a pair of push arms 41*a*, 41*b*. The boss 39 is swingably supported on the second rocker shaft 38. The boss 39 is offset on one side in an axial direction of the second rocker shaft 38 relative to the bore center line O1.

The roller support 40 is arranged to bifurcate and to project toward the intake cam 26 of the camshaft 18 from an outer peripheral surface of the boss 39. The roller support 40 supports a roller bearing 42. The roller bearing 42 is positioned at one end of the intake rocker arm 20 so as to come into rolling contact with the base circle 28*a* and the cam nose 28*b* of the intake cam 26. A center X3 of rotation of the roller bearing 42 is offset toward the second rocker shaft 38 relative to the bore center line O1, which passes through the center X1 of rotation of the camshaft 18.

As shown in FIGS. 2 and 4, the push arms 41*a*, 41*b* project toward the valve stems 13*a* of the intake valves 13 from an outer peripheral surface of the boss 39. The two valve stems 13*a* are evenly distributed with the bore center line O1 being disposed therebetween.

In contrast, the boss 39 is offset on one side in the axial direction of the second rocker shaft 38 relative to the bore center line O1. Therefore, one 41*a* of the push arms and the other 41*b* of the push arms are different in length from each other. The other 41*b* of the push arms, which pushes the valve stem 13*a* disposed away from the boss 39, crosses the line A. Further, a space D1 between projecting ends of the push arms 41*a*, 41*b* is larger than a space D2 between the projecting ends of the push arms 33*a*, 33*b* of the exhaust rocker arm 19.

The projecting ends of the push arms 41*a*, 41*b* are positioned at the other end of the intake rocker arm 20 and opposed to the tip ends of the valve stems 13*a*. Adjust screws 43, respectively, are screwed into the projecting ends of the push arms 41*a*, 41*b*. The adjust screws 43 abut against the tip ends of the valve stems 13*a*. Accordingly, the intake rocker arm 20 extends across the second rocker shaft 38 from the intake cam 26 to the tip ends of the valve stems 13*a* of the intake valve 13.

A pair of oil supply ports 44 are formed on the boss 39 of the intake rocker arm 20. The oil supply ports 44 receive the lubricating oil from the oil jet ports 29*a*, 29*b* of the camshaft 18 and apply the oil between the boss 39 and the second rocker shaft 38. The oil supply ports 44 are spaced away from each other in an axial direction of the boss 39.

As shown in FIG. 2, when the roller bearing 34 on the exhaust rocker arm 19 contacts with the base circle 27*a* of the exhaust cam 25, the first rocker shaft 30, which supports the exhaust rocker arm 19, is moved closer to the camshaft 18 along the bore center line O1 of the cylinder 4 than the center X2 of rotation of the roller bearing 34 is. In other words, a center X4 of the first rocker shaft 30 is disposed in a lower position than the center X2 of rotation of the roller bearing 34 as long as the roller bearing 34 contacts with the base circle 27*a*.

Based on this, an intersecting angle θ1 is set to, for example, approximately 92° where θ1 indicates an intersecting angle between a line B1, which connects between the center X4 of the first rocker shaft 30 and the center X2 of rotation of the roller bearing 34, and a line B2, which connects between the center X1 of rotation of the camshaft 18 and the center X2 of rotation of the roller bearing 34.

When the roller bearing 42 on the intake rocker arm 20 contacts with the base circle 28*a* of the intake cam 26, the second rocker shaft 38, which supports the intake rocker arm 20, is moved farther from the camshaft 18 than the center X3 of rotation of the roller bearing 42 is. In other words, a center X5 of the second rocker shaft 38 is disposed in a higher position than the center X3 of rotation of the roller bearing 42 as long as the roller bearing 42 contacts with the base circle 28*a*.

Therefore, an intersecting angle θ2 is set to, for example, approximately 76° where θ2 indicates an intersecting angle between a line C1, which connects between the center X5 of the second rocker shaft 38 and the center X3 of rotation of the roller bearing 42, and a line C2, which connects between the center X1 of rotation of the camshaft 18 and the center X3 of rotation of the roller bearing 42.

Accordingly, the intersecting angle θ1 is larger than the intersecting angle θ2 (θ1>θ2).

As shown in FIG. 3, the cylinder head 3 includes a recess 46, which caves toward the center of the combustion chamber 8. The recess 46 is positioned in opposition to the camshaft 18 with the bore center line O1 disposed therebetween. A plug mount hole 47 is formed at a bottom of the recess 46 to be opened to the center of the combustion chamber 8. An ignition plug 48 is screwed into the plug mount hole 47. An insulating material 48*a* of the ignition plug 48 is positioned in the recess 46.

With such a cylinder head 3, the camshaft 18 is offset radially of the cylinder 4 relative to the bore center line O1. Therefore, a large space for formation of the recess 46 can be ensured in that portion of the cylinder head 3 which is opposed to the camshaft 18 with the bore center line C1 disposed therebetween. As a result, the recess 46 can be located close to the bore center line O1, so that it is possible to have the ignition plug 48 standing upright relative to the combustion chamber 8.

As shown in FIGS. 2 and 4, the cylinder head 3 includes a first opening 50 and a second opening 51, which are opened to the valve gear chamber 16. The first opening 50 allows for tappet adjustment of the exhaust valves 12, and is shaped in a manner to expose abutting portions of the valve stems 12*a* of the exhaust valves 12 and the push arms 33*a*, 33*b* of the exhaust rocker arm 19. The first opening 50 is positioned at a front end of the cylinder head 3.

The second opening 51 allows for tappet adjustment of the intake valves 13, and is shaped in a manner to expose abutting portions of the valve stems 13*a* of the intake valves 13 and the push arms 41*a*, 41*b* of the intake rocker arm 20. The second opening 51 is positioned at a rear end of the cylinder head 3. The first and second openings 50, 51 preferably have substantially the same shape as each other.

As shown in FIG. 2, the first and second openings 50, 51, respectively, are preferably covered by tappet covers 52. The tappet cover 52, which covers the first opening 50, and the tappet cover 52, which covers the second opening 51, are common to each other and fixed to the cylinder head 3 in a removable manner.

The tappet covers 52 include an inner surface exposed to the valve gear chamber 16. First and second walls 54, 55 are formed on the inner surfaces of the tappet covers 52. The first and second walls 54, 55 project obliquely downward toward the valve gear chamber 16 so as to receive the lubricating oil applied from the oil jet ports 29*a*, 29*b* of the camshaft 18. The first and second walls 54, 55 are aligned and spaced at intervals along a height direction of the cylinder head 3, and extend axially of the first and second rocker shafts 30, 38.

Figure 5:
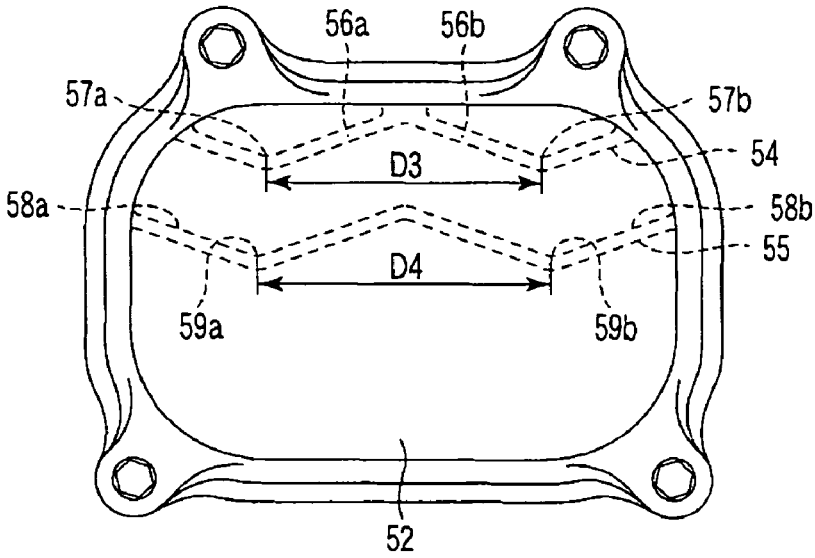
FIG. 5 is a plan view showing tappet covers according to a preferred embodiment of the invention.

As shown in FIG. 5, the first wall 54 is positioned above the second wall 55. The first wall 54 preferably includes a pair of V-shaped oil guides 56*a*, 56*b*. The oil guides 56*a*, 56*b* include supply ports 57*a*, 57*b*, which are arranged to extend in a width direction of the tappet cover 52 and are arranged to drip the lubricating oil, which is received by the first wall 54. A space D3 between the supply ports 57*a*, 57*b* corresponds to the space D2 between the push arms 33*a*, 33*b* of the exhaust rocker arm 19.

The second wall 55 positioned below the first wall 54 includes a pair of V-shaped oil guides 58*a*, 58*b*. The oil guides 58*a*, 58*b* include supply ports 59*a*, 59*b*, which are arranged to extend in a width direction of the tappet cover 52 and are arranged to drip the lubricating oil, which is received by the second wall 55. A space D4 provided between the supply ports 59*a*, 59*b* corresponds to the space D1 between the push arms 41*a*, 41*b* of the intake rocker arm 20.

As a result of this unique structure, the supply ports 57*a*, 57*b* of the first wall 54 are positioned just above the projecting ends of the push arms 33*a*, 33*b* of the exhaust rocker arm 19 in a state in which the first opening 50 on an exhaust side is covered by the tappet cover 52. Accordingly, the lubricating oil is supplied through the supply ports 57*a*, 57*b* to abutting portions of the adjust screws 35 and the valve stems 12*a* of the exhaust valves 12.

Likewise, the supply ports 59*a*, 59*b* of the second wall 55 are positioned just above the projecting ends of the push arms 41*a*, 41*b* of the intake rocker arm 20 in a state in which the second opening 51 on an intake side is covered by the tappet cover 52. Accordingly, the lubricating oil is supplied through the supply ports 59*a*, 59*b* to abutting portions of the adjust screws 43 and the valve stems 13*a* of the intake valves 13.

Accordingly, although the first opening 50 on the exhaust side and the second opening 51 on the intake side are covered by the common tappet covers 52, it is possible to surely supply the lubricating oil to the abutting portions of the adjust screws 35 and the exhaust valves 12 and the abutting portions of the adjust screws 43 and the intake valves 13.

In particular, according to the present preferred embodiment, the boss 31 of the exhaust rocker arm 19 and the boss 39 of the intake rocker arm 20 are offset relative to the bore center line O1 axially of the first and second rocker shafts 30, 38. Therefore, the oil jet ports 29*a*, 29*b* of the camshaft 18, from which the lubricating oil is applied, are distant from the valve stem 12*a* of the other of the exhaust valves 12 and the valve stem 13*a* of the other of the intake valves 13. As a result, the lubricating conditions of the other of the exhaust valves 12 and the other of the intake valves 13 become strict at the time of idling operation, at which the lubricating oil is applied in small amounts.

With the above constitution, the lubricating oil can be supplied to the abutting portions of the adjust screws 35 and the other of the exhaust valves 12 and the abutting portions of the adjust screws 43 and the other of the intake valves 13 from the supply ports 57*a*, 57*b*, 59*a*, 59*b* formed on the tappet covers 52. Therefore, even when the abutting portions are distant from the oil jet ports 29*a*, 29*b*, the amount of lubricating oil being supplied to the abutting portions will not be small. Accordingly, the reliability of the lubrication is greatly improved.

Subsequently, an operation of the valve gear 17 will be described with reference to FIG. 6.

FIG. 2 shows a state in which the roller bearing 34 on the exhaust rocker arm 19 and the roller bearing 42 on the intake rocker arm 20, respectively, contact with the base circle 27*a* of the exhaust cam 25 and the base circle 28*a* of the intake cam 26. At this time, the exhaust valves 12 and the intake valves 13 are closed.

When the camshaft 18 rotates forward in a counter clockwise direction indicated by the arrow in FIG. 2, the roller bearing 34 on the exhaust rocker arm 19 contacts and rides on the cam nose 27*b* as it moves from the base circle 27*a* of the exhaust cam 25. The cam nose 27*b* pushes up the roller bearing 34 of the exhaust rocker arm 19. Therefore, the exhaust rocker arm 19 swings on the first rocker shaft 30, and the push arms 33*a*, 33*b* of the exhaust rocker arm 19 push down the valve stems 12*a* of the exhaust valves 12. Accordingly, the exhaust valves 12 are opened.

Subsequently, the roller bearing 42 on the intake rocker arm 20 contacts and rides on the cam nose 28*b* as it moves from the base circle 28*a* of the intake cam 26. The cam nose 28*b* pushes up the roller bearing 42 of the intake rocker arm 20. Therefore, the intake rocker arm 20 swings on the second rocker shaft 38, and the push arms 41*a*, 41*b* of the intake rocker arm 20 push down the valve stems 13*a* of the intake valves 13. Accordingly, the intake valves 13 are opened.

The second rocker shaft 38, which supports the intake rocker arm 20, is positioned rearwardly of the bore center line O1, which passes through the center X1 of rotation of the camshaft 18, in the direction of rotation of the camshaft 18. Therefore, the cam nose 28*b* of the intake cam 26 is moved away from the second rocker shaft 38 during the process in which the cam nose 28*b* pushes up the roller bearing 42.

Accordingly, the second rocker shaft 38 will not be moved in a direction in which the roller bearing 42 is pushed up. As a result, a force with which the cam nose 28*b* pushes up the roller bearing 42 acts as a force by which the intake rocker arm 20 is caused to swing on the second rocker shaft 38.

On the other hand, the first rocker shaft 30, which supports the exhaust rocker arm 19, is positioned forwardly of the bore center line O1, which passes through the center X1 of rotation of the camshaft 18, in the direction of rotation of the camshaft 18. The first rocker shaft 30 is disposed in a lower position than the center X2 of rotation of the roller bearing 34 when the roller bearing 34 of the exhaust rocker arm 19 contacts with the base circle 27*a* of the exhaust cam 25.

By virtue of this, the first rocker shaft 30 will not be moved in a direction in which the roller bearing 34 is pushed up during the process in which the cam nose 27*b* of the exhaust cam 25 pushes up the roller bearing 34. Accordingly, a force F exerted on a contact portion at which the cam nose 27*b* and the roller bearing 34 contact with each other, acts in a different direction from that of the line B1, which connects between the center X2 of rotation of the roller bearing 34 and the center X4 of the first rocker shaft 30, as shown by an arrow in FIG. 6.

In other words, the valve gear 17 determines and controls the relationship of relative positions of the center X4 of the first rocker shaft 30, the center X2 of rotation of the roller bearing 34 of the exhaust rocker arm 19, and the center X1 of rotation of the camshaft 18 such that the exhaust rocker arm 19 does not buckle when the exhaust rocker arm 19 swings in a direction in which the exhaust valves 12 is opened.

Although the first rocker shaft 30 is positioned forwardly of the bore center line O1 in the direction of rotation of the camshaft 18, it is difficult for the exhaust rocker arm 19 to bear a buckling load. Therefore, it is possible to decrease a load being borne by the exhaust rocker arm 19, so that it is not necessary to implement large-scaled reinforcement to enable the exhaust rocker arm 19 to withstand a buckling load. Accordingly, the exhaust rocker arm 19 can be constructed to be lightweight and compact.

Further, with the above-described unique construction, almost all of a force with which the cam nose 27*b* pushes up the roller bearing 34 can be effectively used as a force that swings the exhaust rocker arm 19. Thereby, the exhaust rocker arm 19 swings smoothly. Accordingly, it is possible to make the exhaust rocker arm 19 lightweight and to easily handle high-speed rotation of the engine 1.

In addition, since the first rocker shaft 30 is positioned lower than the camshaft 18, the upper surface of the cylinder head 3 can be lowered in position. Accordingly, the compactness of the cylinder head 3 is greatly improved.

The present invention is not limited to the above-described preferred embodiments but can be carried out in various modifications within the scope not departing from the gist of the invention.

While the above-described preferred embodiments are preferably directed to a so-called four-valve engine, in which a pair of exhaust valves and a pair of intake valves are provided in one combustion chamber, the present invention is not limited thereto. The present invention can be carried out in, for example, a two-valve engine, in which one exhaust valve and one intake valve are provided in one combustion chamber, or likewise in a three-valve engine, in which one exhaust valve and a pair of intake valves are provided in one combustion chamber.

In addition, the rocker arm supported by the first rocker shaft, which is positioned forward in the direction of rotation of the camshaft, is not limited to a rocker arm that drives the exhaust valves but may be a rocker arm that drives the intake valves.

Further, there is no need to arrange the camshaft on the bore center line. For example, the camshaft maybe offset toward the exhaust valves or the intake valves relative to the bore center line.

According to preferred embodiments of the present invention, the load being borne by the first rocker arm is significantly decreased. Accordingly, it is not necessary to undertake large-scaled reinforcement of the first rocker arm to enable the first rocker arm to withstand a buckling load. As a result, the first rocker arm can be made small-sized and lightweight.

It should be understood that the foregoing description is only illustrative of the present invention. Various alternatives and modifications can be devised by those skilled in the art without departing from the present invention. Accordingly, the present invention is intended to embrace all such alternatives, modifications, and variances that fall within the scope of the appended claims.

The invention claimed is:

1. A valve gear comprising:

a camshaft having a first valve gear cam and a second valve gear cam;

first and second rocker shafts arranged such that the camshaft is disposed between the first and second rocker shafts;

a first rocker arm swingably supported on the first rocker shaft and having a roller bearing at one end thereof, the roller bearing of the first rocker arm being arranged to contact with the first valve gear cam; and a second rocker arm swingably supported on the second rocker shaft and having a roller bearing at one end thereof, the roller bearing of the second rocker arm being arranged to contact with the second valve gear cam; wherein the first and second valve gear cams of the camshaft, respectively, include a base circle and a cam nose projecting from the base circle, and the first rocker arm and the first valve gear cam are arranged such that when the roller bearing of the first rocker arm contacts with the base circle of the first valve gear cam, the first rocker shaft is located closer to the camshaft than a location of a center of rotation of the roller bearing of the first rocker arm.

2. The valve gear according to claim 1, wherein the first rocker shaft is arranged to support the first rocker arm and is positioned forwardly of a center line which passes through a center of the camshaft to extend axially of a cylinder in a direction of rotation of the camshaft, and the second rocker shaft is arranged to support the second rocker arm and is positioned rearwardly of the center line in the direction of rotation of the camshaft.

3. The valve gear according to claim 2, wherein the roller bearing of the first rocker arm and the roller bearing of the second rocker arm, respectively, are offset relative to the center line of the cylinder in an axial direction of the camshaft, and the roller bearing of the first rocker arm offset farther from the center line than the roller bearing of the second rocker arm.

4. The valve gear according to claim 1, wherein the second rocker arm and the second valve gear cam are arranged such that when the roller bearing of the second rocker arm contacts with the base circle of the second valve gear cam, the second rocker shaft is located farther away from the camshaft than a center of rotation of the roller bearing of the second rocker arm.

5. The valve gear according to claim 1, wherein the first rocker arm opens and closes at least one exhaust valve and the second rocker arm opens and closes at least one intake valve.

6. The valve gear according to claim 1, wherein the first rocker arm and the first valve gear cam are arranged such that when the roller bearing of the first rocker arm contacts with the base circle of the first valve gear cam, a force exerted on a contact portion at which the cam nose and the roller bearing of the first rocker arm contact each other does not act along a line which connects a center of rotation of the roller bearing of the first rocker shaft and a center of the first rocker shaft.

7. The valve gear according to claim 1, wherein the first rocker arm and the first valve gear cam are arranged such that the first rocker shaft is not moved in a direction in which the roller bearing of the first rocker arm is moved when the cam nose of the first valve gear cam contacts and pushes up the roller bearing of the first rocker shaft.

8. The valve gear according to claim 1, wherein the following relationship is satisfied: $\theta 1 > \theta 2$; wherein $\theta 1$ indicates an intersecting angle between a line which connects the center of the first rocker shaft and the center of rotation of the roller bearing of the first rocker arm, and a line which connects a center of rotation of the camshaft and the center of rotation of the roller bearing of the first rocker arm, and $\theta 2$ indicates an intersecting angle between a line which connects a center of the second rocker shaft and a center of rotation of the roller bearing of the second rocker arm, and a line which connects the center of rotation of the camshaft and the center of rotation of the roller bearing of the second rocker arm.

9. The valve gear according to claim 8, wherein the intersecting angle $\theta 1$ is larger than approximately 90 degrees and the intersecting angle $\theta 2$ is smaller than approximately 90 degrees.

10. An engine comprising the valve gear according to claim 1.

11. An engine according to claim 10, wherein the engine is a four-cycle engine.

12. A vehicle comprising the engine according to claim 10.

13. A vehicle according to claim 12, wherein the vehicle is a motorcycle.

14. A valve gear comprising:

a camshaft having a first valve gear cam and a second valve gear cam;

first and second rocker shafts arranged such that the camshaft is disposed between the first and second rocker shafts;

a first rocker arm swingably supported on the first rocker shaft and having a roller bearing at one end thereof, the roller bearing of the first rocker arm being arranged to contact with the first valve gear cam; and a second rocker arm swingably supported on the second rocker shaft and having a roller bearing at one end thereof, the roller bearing of the second rocker arm being arranged to contact with the second valve gear cam; wherein the first and second valve gear cams of the camshaft, respectively, include a base circle and a cam nose projecting from the base circle, and the first rocker arm and the first valve gear cam are arranged such that a relationship between relative positions of a center of the first rocker shaft, a center of rotation of the roller bearing of the first rocker arm, and a center of rotation of the camshaft is such that the first rocker arm does not buckle when the cam nose of the first valve gear cam contacts with the roller bearing of the first rocker arm to cause the first rocker arm to swing in a valve opening direction.

15. The valve gear according to claim 14, wherein the first rocker shaft is arranged to support the first rocker arm and is positioned forwardly of a center line which passes through a center of the camshaft to extend axially of a cylinder in a direction of rotation of the camshaft, and the second rocker shaft is arranged to support the second rocker arm and is positioned rearwardly of the center line in the direction of rotation of the camshaft.

16. The valve gear according to claim 15, wherein the roller bearing of the first rocker arm and the roller bearing of the second rocker arm, respectively, are offset relative to the center line of the cylinder in an axial direction of the camshaft, and the roller bearing of the first rocker arm offset farther from the center line than the roller bearing of the second rocker arm.

17. The valve gear according to claim 15, wherein the first rocker arm and the first valve gear cam are arranged such that when the roller bearing of the first rocker arm contacts with the base circle of the first valve gear cam, the first rocker shaft is located closer to the camshaft than a location of a center of rotation of the roller bearing of the first rocker arm.

18. The valve gear according to claim 17, wherein the second rocker arm and the second valve gear cam are arranged such that when the roller bearing of the second rocker arm contacts with the base circle of the second valve gear cam, the second rocker shaft is located farther away from the camshaft than a center of rotation of the roller bearing of the second rocker arm.

19. The valve gear according to claim 15, wherein the first rocker arm opens and closes at least one exhaust valve and the second rocker arm opens and closes at least one intake valve.

20. The valve gear according to claim 15, wherein the first rocker arm and the first valve gear cam are arranged such that when the roller bearing of the first rocker arm contacts with the base circle of the first valve gear cam, a force exerted on a contact portion at which the cam nose and the roller bearing of the first rocker arm contact each other does not act along a line which connects a center of rotation of the roller bearing of the first rocker shaft and a center of the first rocker shaft.

21. The valve gear according to claim 15, wherein the first rocker arm and the first valve gear cam are arranged such that the first rocker shaft is not moved in a direction in which the roller bearing of the first rocker arm is moved when the cam nose of the first valve gear cam contacts and pushes up the roller bearing of the first rocker shaft.

22. The valve gear according to claim 15, wherein the following relationship is satisfied: $\theta 1 > \theta 2$; wherein $\theta 1$ indicates an intersecting angle between a line which connects the center of the first rocker shaft and the center of rotation of the roller bearing of the first rocker arm, and a line which connects a center of rotation of the camshaft and the center of rotation of the roller bearing of the first rocker arm, and $\theta 2$ indicates an intersecting angle between a line which connects a center of the second rocker shaft and a center of rotation of the roller bearing of the second rocker arm, and a line which connects the center of rotation of the camshaft and the center of rotation of the roller bearing of the second rocker arm.

23. The valve gear according to claim 22, wherein the intersecting angle $\theta 1$ is larger than approximately 90 degrees and the intersecting angle $\theta 2$ is smaller than approximately 90 degrees.

24. An engine comprising the valve gear according to claim 15.

25. An engine according to claim 24, wherein the engine is a four-cycle engine.

26. A vehicle comprising the engine according to claim 24.

27. A vehicle according to claim 26, wherein the vehicle is a motorcycle.

28. A valve gear comprising:

a camshaft having a first valve gear cam and a second valve gear cam;

first and second rocker shafts arranged such that the camshaft is disposed between the first and second rocker shafts;

a first rocker arm swingably supported on the first rocker shaft and having a roller bearing at one end thereof, the roller bearing of the first rocker arm being arranged to contact with the first valve gear cam; and a second rocker arm swingably supported on the second rocker shaft and having a roller bearing at one end thereof, the roller bearing of the second rocker arm being arranged to contact with the second valve gear cam; wherein the first and second valve gear cams of the camshaft, respectively, include a base circle and a cam nose projecting from the base circle, and the first rocker arm and the first valve gear cam are arranged such that when the roller bearing of the first rocker arm contacts with the base circle of the first valve gear cam, a force exerted on a contact portion at which the cam nose and the roller bearing of the first rocker arm contact each other does not act along a line which connects a center of rotation of the roller bearing of the first rocker shaft and a center of the first rocker shaft.

29. The valve gear according to claim 28, wherein the first rocker shaft is arranged to support the first rocker arm and is positioned forwardly of a center line which passes through a center of the camshaft to extend axially of a cylinder in a direction of rotation of the camshaft, and the second rocker shaft is arranged to support the second rocker arm and is positioned rearwardly of the center line in the direction of rotation of the camshaft.

30. The valve gear according to claim 29, wherein the roller bearing of the first rocker arm and the roller bearing of the second rocker arm, respectively, are offset relative to the center line of the cylinder in an axial direction of the camshaft, and the roller bearing of the first rocker arm offset farther from the center line than the roller bearing of the second rocker arm.

31. The valve gear according to claim 28, wherein the second rocker arm and the second valve gear cam are arranged such that when the roller bearing of the second rocker arm contacts with the base circle of the second valve gear cam, the second rocker shaft is located farther away from the camshaft than a center of rotation of the roller bearing of the second rocker arm.

32. The valve gear according to claim 28, wherein the first rocker arm opens and closes at least one exhaust valve and the second rocker arm opens and closes at least one intake valve.

33. The valve gear according to claim 28, wherein the first rocker arm and the first valve gear cam are arranged such that the first rocker shaft is not moved in a direction in which the roller bearing of the first rocker arm is moved when the cam nose of the first valve gear cam contacts and pushes up the roller bearing of the first rocker shaft.

34. The valve gear according to claim 28, wherein the following relationship is satisfied: $\theta 1 > \theta 2$; wherein $\theta 1$ indicates an intersecting angle between a line which connects the center of the first rocker shaft and the center of rotation of the roller bearing of the first rocker arm, and a line which connects a center of rotation of the camshaft and the center of rotation of the roller bearing of the first rocker arm, and $\theta 2$ indicates an intersecting angle between a line which connects a center of the second rocker shaft and a center of rotation of the roller bearing of the second rocker arm, and a line which connects the center of rotation of the camshaft and the center of rotation of the roller bearing of the second rocker arm.

35. The valve gear according to claim 34, wherein the intersecting angle $\theta 1$ is larger than approximately 90 degrees and the intersecting angle $\theta 2$ is smaller than approximately 90 degrees.

36. An engine comprising the valve gear according to claim 28.

37. An engine according to claim 36, wherein the engine is a four-cycle engine.

38. A vehicle comprising the engine according to claim 36.

39. A vehicle according to claim 38, wherein the vehicle is a motorcycle.

40. A valve gear comprising:

a camshaft having a first valve gear cam and a second valve gear cam;

first and second rocker shafts arranged such that the camshaft is disposed between the first and second rocker shafts;

a first rocker arm swingably supported on the first rocker shaft and having a roller bearing at one end thereof, the roller bearing of the first rocker arm being arranged to contact with the first valve gear cam; and a second rocker arm swingably supported on the second rocker shaft and having a roller bearing at one end thereof, the roller bearing of the second rocker arm being arranged to contact with the second valve gear cam; wherein the first and second valve gear cams of the camshaft, respectively, include a base circle and a cam nose projecting from the base circle, and the first rocker arm and the first valve gear cam are arranged such that the first rocker shaft is not moved in a direction in which the roller bearing of the first rocker arm is moved when the cam nose of the first valve gear cam contacts and pushes up the roller bearing of the first rocker shaft;

$\theta 1$ indicates an intersecting angle between a line which connects the center of the first rocker shaft and the center of rotation of the roller bearing of the first rocker arm, and a line which connects a center of rotation of the camshaft and the center of rotation of the roller bearing of the first rocker arm: and $\theta 1$ is larger than approximately 90 degrees.

41. The valve gear according to claim 40, wherein the first rocker shaft is arranged to support the first rocker arm and is positioned forwardly of a center line which passes through a center of the camshaft to extend axially of a cylinder in a direction of rotation of the camshaft, and the second rocker shaft is arranged to support the second rocker arm and is positioned rearwardly of the center line in the direction of rotation of the camshaft.

42. The valve gear according to claim 41, wherein the roller bearing of the first rocker arm and the roller bearing of the second rocker arm, respectively, are offset relative to the center line of the cylinder in an axial direction of the camshaft, and the roller bearing of the first rocker arm offset farther from the center line than the roller bearing of the second rocker arm.

43. The valve gear according to claim 40, wherein the second rocker arm and the second valve gear cam are arranged such that when the roller bearing of the second rocker arm contacts with the base circle of the second valve gear cam, the second rocker shaft is located farther away from the camshaft than a center of rotation of the roller bearing of the second rocker arm.

44. The valve gear according to claim 40, wherein the first rocker arm opens and closes at least one exhaust valve and the second rocker arm opens and closes at least one intake valve.

45. The valve gear according to claim 40, wherein the following relationship is satisfied: $\theta 1 > \theta 2$; wherein $\theta 2$ indicates an intersecting angle between a line which connects a center of the second rocker shaft and a center of rotation of the roller bearing of the second rocker arm, and a line which connects the center of rotation of the camshaft and the center of rotation of the roller bearing of the second rocker arm.

46. The valve gear according to claim 45, wherein the intersecting angle $\theta 2$ is smaller than approximately 90 degrees.

47. An engine comprising the valve gear according to claim 40.

48. An engine according to claim 47, wherein the engine is a four-cycle engine.

49. A vehicle comprising the engine according to claim 47.

50. A vehicle according to claim 49, wherein the vehicle is a motorcycle.

51. A four-cycle engine comprising:

a cylinder having a bore center line;

a cylinder head connected to the cylinder and having an exhaust valve and an intake valve;

a camshaft supported by the cylinder head and having a first valve gear cam and a second valve gear cam;

first and second rocker shafts arranged such that the camshaft is disposed between the first and second rocker shafts;

a first rocker arm swingably supported on the first rocker shaft and having a roller bearing at one end thereof, the roller bearing of the first rocker arm being arranged to contact with the first valve gear cam, the first rocker arm acting to drive one of the exhaust valve and the intake valve; and a second rocker arm swingably supported on the second rocker shaft and having a roller bearing at one end thereof, the roller bearing of the second rocker arm being arranged to contact with the second valve gear cam, the second rocker arm acting to drive the other of the exhaust valve and the intake valve; wherein the first and second valve gear cams of the camshaft, respectively, include a base circle and a cam nose projecting from the base circle, and the first rocker arm and the first valve gear cam are arranged such that when the roller bearing of the first rocker arm contacts with the base circle of the first valve gear cam, the first rocker shaft is located closer to the camshaft than a location of a center of rotation of the roller bearing of the first rocker arm.

52. The four-cycle engine according to claim 51, wherein the exhaust valve and the intake valve, respectively, include a valve stem at a first end thereof, and the first rocker arm and the second rocker arm, respectively, include another end to push the valve stem, and the cylinder head includes a first opening to expose abutting portions of the other end of the first rocker arm and the valve stem, and a second opening to expose abutting portions of the other end of the second rocker arm and the valve stem, the first opening and the second opening being arranged to be opposed to each other with the bore center line therebetween and covered by respective common removable covers, and the covers include first and second walls on inner surfaces thereof which are opposed to the abutting portions and arranged to receive a lubricating oil, the first wall being formed with supply ports through which the lubricating oil is applied to the abutting portions of the other end of the first rocker arm and the valve stem, and the second wall being formed with supply ports through which the lubricating oil is applied to the abutting portions of the other end of the second rocker arm and the valve stem.

* * * * *